United States Patent [19]

Jacobs et al.

[11] Patent Number: 4,956,012

[45] Date of Patent: Sep. 11, 1990

[54] DISPERSION ALLOYED HARD METAL COMPOSITES

[75] Inventors: Robert S. Jacobs, Greensburg; Jack Krall, Latrobe, both of Pa.

[73] Assignee: Newcomer Products, Inc., Latrobe, Pa.

[21] Appl. No.: 252,531

[22] Filed: Oct. 3, 1988

[51] Int. Cl.[5] ..... C27C 29/02

[52] U.S. Cl. ..... 75/236; 75/246; 75/255; 75/252; 419/15; 419/18; 419/23; 419/3.2; 419/38

[58] Field of Search ..... 75/236, 246, 252, 255; 419/18, 23, 38, 5, 32

[56] References Cited

U.S. PATENT DOCUMENTS

| | | | |
|---|---|---|---|
| 2,731,711 | 1/1956 | Lucas | 29/182 |
| 3,451,791 | 6/1969 | Meadows | 29/182 |
| 3,660,050 | 5/1972 | Iler et al. | 29/182 |
| 4,013,460 | 3/1977 | Brown et al. | 75/204 |
| 4,017,480 | 4/1977 | Baum | 428/601 |
| 4,101,318 | 7/1978 | Rudy | 75/240 |
| 4,398,952 | 9/1983 | Drake | 419/18 |
| 4,525,178 | 6/1985 | Hall | 51/309 |
| 4,596,693 | 6/1986 | Ishizuka et al. | 419/16 |
| 4,604,106 | 8/1986 | Hall et al. | 51/293 |
| 4,670,408 | 6/1987 | Petzow | 501/87 |
| 4,719,076 | 1/1988 | Geczy | 419/8 |
| 4,872,904 | 10/1989 | Dortman | 75/0.5 BA |

OTHER PUBLICATIONS

Article "Structure and Properties of Dual Properties Carbide for Rock Drilling" by Aronsson, Hartzell and Akerman.

*Primary Examiner*—Stephen J. Lechert, Jr.
*Assistant Examiner*—Nina Bhat
*Attorney, Agent, or Firm*—Buchanan Ingersoll

[57] ABSTRACT

A hard metal composite is formed from a mixture of two or more pre-blended, unsintered hard metal composites in which the properties of each constituent are different. The constituent components are selected so that they have different grain sizes, different binder contents, different metal carbide or binders, or some combination of these. Primarily, the constituents are chosen on the basis of their properties and compatability, and are chosen to utilize the superior properties of one of the constituents without detrimentally affecting the desirable properties of the other. As an example, a pre-blended composite having a superior hardness may be dispersed in a second composite having a superior toughness with the resultant material having a hardness which approaches that of the harder constituent yet maintaining the toughness of the matrix constituent.

17 Claims, 5 Drawing Sheets

9X 23.5X

DISPERSION ALLOYED HARD METAL COMPOSITES

FIELD OF THE INVENTION

The present invention relates to hard metal composites and more particularly to cemented carbide composites having improved properties.

DESCRIPTION OF THE PRIOR ART

Hard metals are composites consisting of metal carbides, primarily tungsten carbide, and a binder material, generally cobalt, and are commonly known as cemented carbides. The metal carbide and binder material are blended together as powders, pressed, and sintered in a protective atmosphere or vacuum. During sintering, the binder material, which may range from 1% to 25% by weight of the compact, or higher, forms a liquid phase and completely surrounds the metal carbide particles, thereby achieving full density. A "fully" dense hard metal is generally considered one in which the actual density is greater than 99.5% of the theoretical density of the composite.

The resultant cemented tungsten carbide composite exhibits very high hardness and relatively high toughness. Such composites are widely used as metal cutting tools and mining or earth drilling tools. In addition, these composites are used in metal stamping, forming and powder compacting applications.

It is well known that the two most important factors affecting the hardness and toughness properties of fully dense hard metal composites are the binder content and the particle size (grain size) of the metal carbides employed. The lower the binder content of a composite, the higher its hardness. Adversely, the lower the binder content of the composite, the lower its toughness. In addition, the hardness of the composite increases as the particle size of the metal carbide employed is decreased. To a lesser extent, the toughness of the composite decreases as particle size of the metal carbide employed is decreased. Consequently, it has always been necessary to sacrifice either the hardness or toughness of the composite in order to improve the other property by these means.

It is also well known that grain sizes of the metal carbide particles used in hard metal composites range from as low as 0.5 microns (submicron particles) to as high as 20 microns, and even larger for very special applications. Further, it is common knowledge that properties of hard metals can be altered by mixing tungsten carbide grain sizes within a composition while maintaining a constant binder content.

It is also a practice to combine sintered and crushed particles of various compositions of hard metals by brazing or resintering these compositions in the presence of another binder. However, these practices generally do not result in fully dense hard metals because the sintered compositions are surrounded by an oxide film or other impurities. This makes it impossible to achieve the relatively high toughness normally associated with these materials. Consequently, there is a need for a hard metal composite having both high toughness and high hardness properties.

SUMMARY OF THE INVENTION

In the present invention, it has been discovered that combining unsintered nodules of various grades of hard metal compositions produces new hard metals in which the sacrificing of either toughness or hardness for the other is no longer necessary. This is accomplished by producing pellets or nodules of preblended, unsintered metal carbide/binder composites having certain desirable characteristics such as very high hardness, oxidation resistance or gall resistance, and dispersing these nodules into other preblended, unsintered and pelletized metal carbide/binder compositions having other desirable characteristics such as high toughness, corrosion resistance, or other property. The dispersion of the first composite into the second composite occurs prior to pressing and sintering of the mixtures. In this manner, the present invention embodies the creation of materials which are fully dense composites of composites, and in which the integrity of the separate grades is maintained, while the properties of the new composite are enhanced.

In a typical hard metal composite, each particle of metal carbide (or solution of metal carbides) exists as distinct islands entrapped in an envelope of binder metal. As the binder wears away due to abrasion, corrosion, erosion or other mechanism, the metal carbide becomes exposed to an ever increasing degree until it is violently pulled or torn from the binder. New particles are continually exposed in the process, resulting in a regeneration of the wear resistant surface on a microscale. In the present invention, a similar phenomenon occurs, except on a larger scale as nodules of the more concentrated (i.e., more highly wear resistant) constituent become exposed while the relatively tough matrix constituent wears away.

In a preferred embodiment, preblended pellets of very fine grained (submicron) tungsten carbide, 6% cobalt binder material, were mixed with preblended pellets of a coarse grained, 11% cobalt binder material. The submicron grade pellets form the "hard" constituent and the coarse grained grade pellets form the "tough" constituent. After the hard constituent and tough constituent are mixed, they are then pressed and sintered in a normal manner. This composite of composites, or dispersion alloyed hard metal composite, may contain up to approximately 50% by weight of the hard constituent as distinct nodules and the balance as the tough constituent or matrix material. The resultant dispersion alloyed hard metal composite possesses the hardness of the hard constituent and the toughness of the tough constituent.

Any pelletizing process can be used such as vibratory pelletizing, wet pelletizing, slugging and granulating methods or spray drying to produce the pellets or nodules of the select grades. The mixing of the hard and tough constituents is accomplished by a very gentle dry-mixing of the preblended pellets. Pressing and sintering of the hard metal composite is performed by normal means. However, secondary sintering processes such as hot isostatic pressing, or the more modern low pressure sinter-hip method, may enhance the resultant properties of the hard metal composite.

In addition to increasing the hardness of a tough carbide composite, other composites can be developed in which other properties are improved. For example, the oxidation resistance, or lubricity, or other property of a matrix grade composite can be improved without giving up any of the properties of the matrix grade.

DESCRIPTION OF THE PREFERRED EMBODIMENTS

Figure 1:
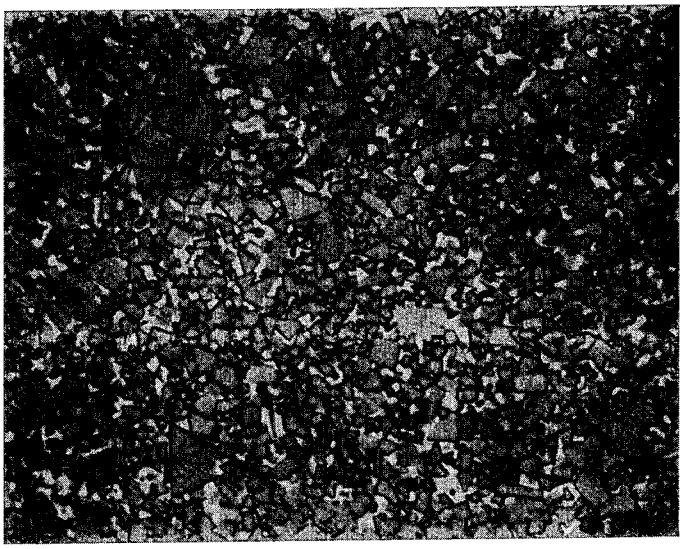
FIG. 1 is a photomicrograph showing a magnification at 1500 diameters of a coarse grained hard metal having 11% by weight binder.

FIG. 1 shows the microstructure of a sintered "coarse" grained hard metal composed of tungsten carbide particles surrounded by a cobalt binder at 1500X. The particle size of the tungsten carbide ranges from 3 to 6 microns. The binder content is 11% by weight. This coarse grained hard metal is a typical grade for high impact resistance application.

Figure 2:
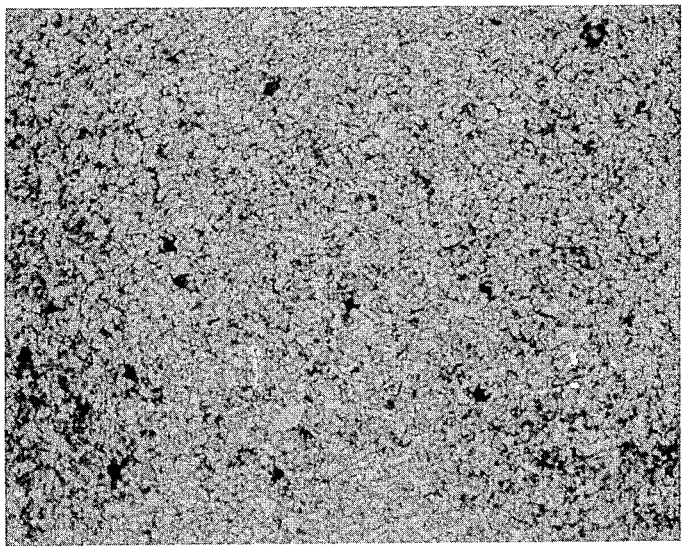
FIG. 2 is a photomicrograph showing a magnification at 1500 diameters of a submicron grained hard metal having 6% by weight binder.

FIG. 2 shows the microstructure of a sintered submicron grained hard metal composed of tungsten carbide and a cobalt binder. The particle size of the tungsten carbide is generally less than 1 micron, although a few grains are in excess of 1 micron. The binder content is 6% by weight. The submicron grained hard metal is a grade used for high wear resistance applications where little impact resistance is required.

The "coarse" grained hard metal of FIG. 1 is a "tough" composition. The submicron grained hard metal of FIG. 2 is a "hard" composition. The present invention combines the "tough" composite and the "hard" composite to form a dispersion alloyed hard metal composite having the toughness of the "tough" composite and the hardness of the "hard" composite.

The dispersion alloyed hard metal composite of the present invention is formed by dispersing unsintered nodules of the "hard" composite of FIG. 2 in unsintered nodules of the "tough" composite of FIG. 1. The constituents of the dispersion alloyed hard metal composite are mixed prior to pressing and sintering of the constituent composites. The dispersion alloyed hard metal composite may contain up to approximately 50% by weight of the "hard" constituent and the balance as the "tough" matrix constituent.

Any pelletizing process can be used to produce the pellets or nodules of the select grades. Preferred processes include vibratory pelletizing, wet pelletizing, slugging and granulating methods, and spray drying. The "hard" and "tough" components are then mixed by a very gentle dry-mixing of the pre-blended pellets. Pressing and sintering of the hard metal composite is then performed by normal means. Secondary sintering processes, such as hot isostatic pressing or a low pressure sinter-hip process may be performed to enhance the resultant properties of the hard metal composite.

Figure 3:
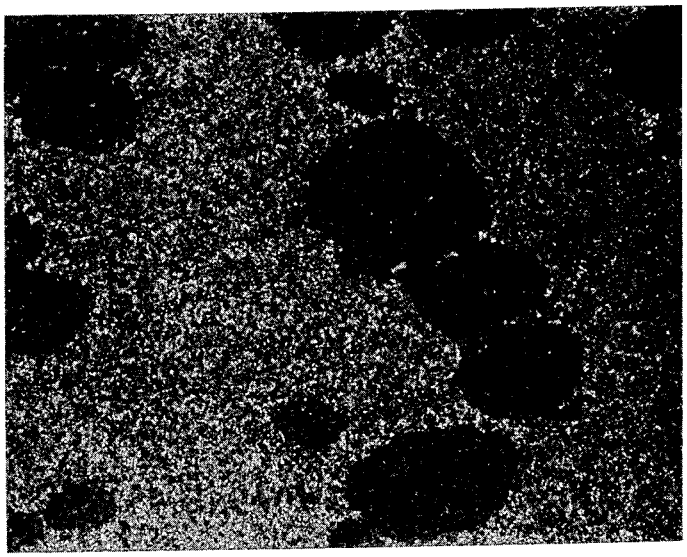
FIG. 3 is a photomicrograph showing a magnification at 100 diameters of a dispersion alloyed hard metal composite according to the present invention.

FIG. 3 shows the dispersion of the "hard" constituent in the "tough" constituent at 100X in the sintered state. Nodules of the submicron grade composite are seen as islands dispersed through the lighter-colored coarse grained matrix. The particular composite shown in FIG. 3 contains 30% of the submicron grade and 70% of the coarse grained grade composites.

Figure 4:
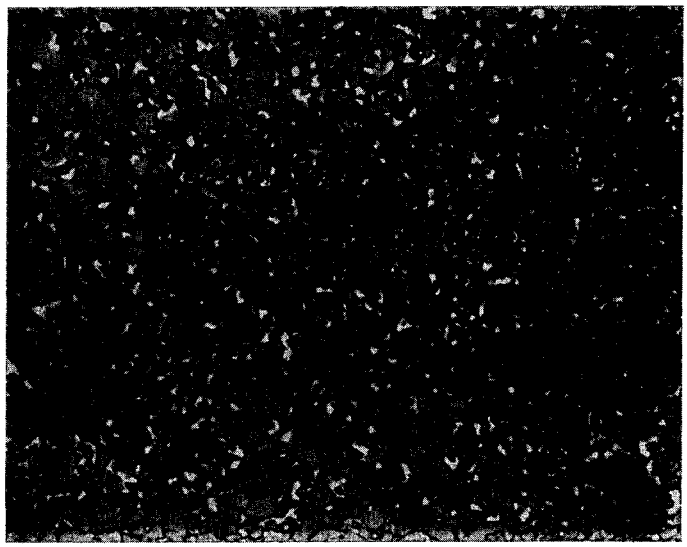
FIG. 4 is a photomicrograph showing a magnification at 1500 diameters of the dispersion alloyed hard metal composite of FIG. 3.

FIG. 4 shows the dispersion alloyed hard metal composite of FIG. 3 at 1500X. The sintering is complete within the individual constituents and between the differing constituent grades. This provides a fully dense composite. Full density is achieved because the pressing and sintering of the constituent composites does not occur until they are fully mixed.

Figure 5:
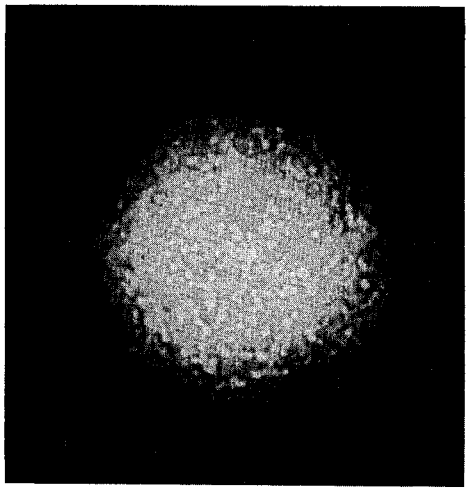
FIG. 5 is a photomacrograph showing a magnification at 9 diameters of the surface of a dispersion alloyed hard metal composite formed in accordance with the present invention.
Figure 6:
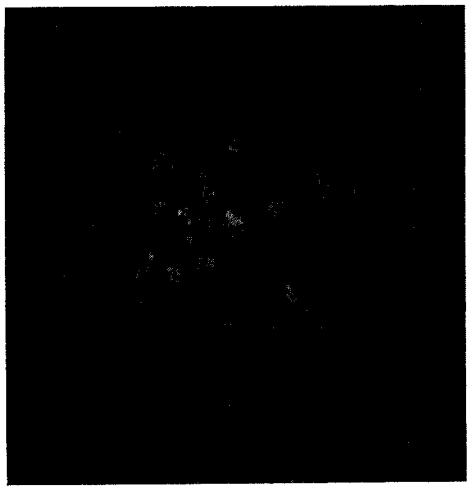
FIG. 6 is a photomacrograph showing a magnification at 23.5 diameters of the dispersion alloyed hard metal composite of FIG. 5.

FIGS. 5 and 6 show the as-sintered surfaces of a dispersion alloyed hard metal composite in which the "harder" constituent (the lighter appearing areas) is dispersed in a coarse-grained grade (the darker appearing areas). In use, the "tough" matrix component of the dispersion alloyed hard metal composite will wear away due to abrasion, corrosion, erosion, or other mechanism, thereby exposing nodules of the hard constituent. The harder constituent will become exposed to an ever increasing degree until it wears away by its normal mechanism, which occurs at a slower rate than the tough matrix. New nodules are continually exposed in this process, resulting in a regeneration of the more wear resistant surface on a macro-scale.

Figure 7:
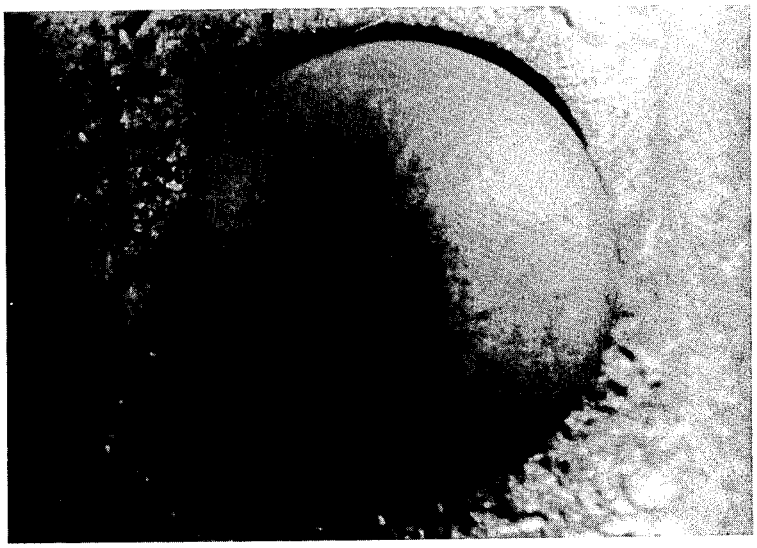
FIG. 7 is a photomacrograph showing a magnification at 8 diameters of the top surface of a compact made of a traditional impact resistant hard metal after 16 hours of wear.
Figure 8:
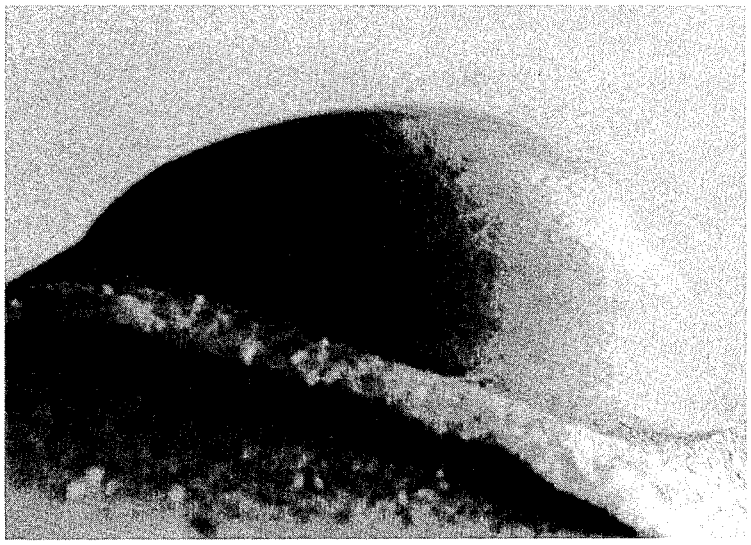
FIG. 8 is a photomacrograph showing a magnification at 10 diameters of a side view of the compact of FIG. 7.

FIGS. 7 and 8 show a compact made of a traditional impact resistant hard metal composite after 16 hours of wear. The surface of the compact is generally smooth. Such a compact wears out evenly and must sacrifice hardness to guarantee toughness.

Figure 9:
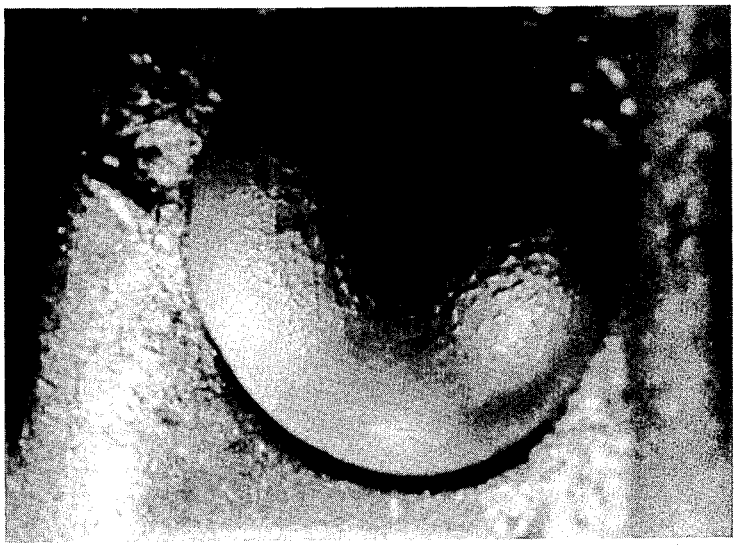
FIG. 9 is a photomacrograph showing a magnification at 8 diameters of the top surface of a dispersion alloyed hard metal composite after 16 hours of wear.
Figure 10:
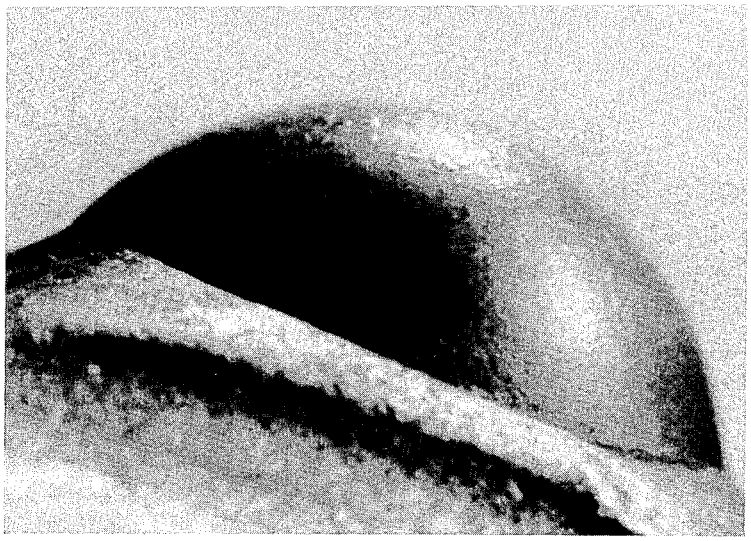
FIG. 10 is a photomacrograph showing a magnification at 10 diameters of a side view of the dispersion alloyed hard metal compact of FIG. 9.

FIGS. 9 and 10 show a compact of a dispersion alloyed hard metal composite according to the present invention after 16 hours of wear. Nodules of the "hard" constituent stand out in relief. Consequently, the "hard" constituent is constantly regenerated as the tough matrix constituent wears away. Because the "hard" constituent is constantly regenerated, the dispersion alloyed composite forms a compact in which desired levels of hardness and toughness can be achieved simultaneously.

A first compact of the shape shown in FIGS. 9 and 10 was formed which contains 30% submicron grade nodules having a 6% binder content dispersed in 70% coarse grained grade nodules having an 11% binder content, which becomes the matrix of the new composite. A second compact was formed which contains 20% submicron grade nodules and 80% coarse grained grade as the matrix. The table below presents the toughness, measured as transverse rupture strength, and hardness characteristics, rated in Rockwell "A" scale, of the submicron grained carbide, the coarse grained carbide, and the 30/70 mixture and the 20/80 mixture. The table also presents the density of the carbide tested. The density is a function of the amount of cobalt binder present in any sample.

TABLE I

| Compound | Density (g/cc) | Toughness (psi) | Hardness (Rockwell A Scale) |
|---|---|---|---|
| submicron grain size WC with 6% Co binder content | 14.95 | 265,000 | 92.6 |
| coarse grain size WC with 11% Co binder content | 14.45 | 452,000 | 88.9 |
| 30/70 composite | 14.61 | 450,000 | 90.0 |
| 20/80 composite | 14.55 | 476,000 | 89.7 |

As Table I reveals, both the 30/70 composite and the 20/80 composite retain the same toughness properties of the coarse-grain sized matrix. However, each of the composites has achieved an increased hardness. In fact, preliminary experimental data shows that the hardness of the 30/70 composite will approach, if not equal, the hardness of the submicron sized nodules. Because the exposed nodules of the hard component, as shown in FIG. 10, perform the actual cutting or drilling operation, it is believed that the effective hardness of the composite will equal the hardness of the harder nodules. Because the nodules are formed entirely of the submicron sized component, the hardness of these nodules, and hence the hardness of the composite, would be the same as that of the submicron sized component.

The compact of FIGS. 9 and 10 is used as the cutting element of an earth-drilling insert which illustrates but one of a variety of applications of the composites of our present invention. In addition, compacts can be formed having application to other drilling, mining, and cutting operations. The composite can be used as a brazed cutting element of metal cutting tool or as a metal cutting insert for a metal cutting tool. Additionally, the composite can be used as the cutting element for an earth-drilling tool, a mining tool, a woodworking tool or other material cutting tool. Moreover, the composite can be used as the working surface of a wear part or a compacting tool.

In addition to tungsten carbide, other cemented carbide materials can be used to form our hard metal composites. Titanium carbide, tantalum carbide, niobium carbide and any combination thereof can be effectively used in accordance with the present invention. Moreover, a mixture of tungsten carbide with any of the materials identified above can be used.

Although we have described a composite which enhances both the hardness and toughness properties of a hard metal product, it is to be understood that other products which maximize different properties of hard metals can be formed in accordance with this invention. Composites having desired oxidation resistance or improved lubricity or other desired property can be dispersed within a matrix having other desired properties. Such a dispersed alloy forms a compact which possesses the desired property of the dispersed composite without sacrificing a desired property of the matrix composite. It is believed, for example, that nodules of a titanium carbide rich composite can be dispersed in a tungsten carbide-cobalt matrix to form an oxide resistant alloy suitable for cutting steel.

In the foregoing specification we have set out certain preferred practices and embodiments of this invention. However, it will be understood that this invention may be otherwise embodied within the scope of the following claims.

We claim:

1. A sintered hard metal composite comprising unsintered nodules of a pre-blended hard metal powder of a first grade uniformly dispersed among unsintered nodules of a pre-blended hard metal of a second grade, said hard metal powder of a first grade and said hard metal powder of a second grade having distinctively different properties from each other, wherein the integrity of the constituent grades is maintained after sintering, and the resulting composite exhibits hardness and toughness properties greater than the average of those properties of the hard metal powder of the first grade and the hard metal powder of the second grade.

2. The hard metal composite of claim 1 in which the constituent hard metal powders comprise tungsten carbide and a binder, each of the constituent hard metal powders having distinctively different properties from the other.

3. The hard metal composite of claim 1 in which at least one of the constituent hard metal powders comprises tungsten carbide and a binder.

4. The hard metal composite of claim 1 wherein at least one of the constituent hard metal powders comprises a binder material selected from the group consisting of cobalt, nickel and iron.

5. The hard metal composite of claim 1 wherein the particle size of the hard metal powder of the first grade is different than the particle size of the hard metal powder of the second grade.

6. The hard metal composite of claim 1 wherein the hard metal powder of the first grade comprises tungsten carbide and a metal binder and the hard metal powder of the second grade comprises a binder and at least one of titanium carbide, tantalum carbide, niobium carbide and tungsten carbide, either independently or mutually dissolved in each other.

7. The hard metal composite of claim 1 wherein said composite comprises one of a cutting element of a metal cutting tool and a metal cutting insert in such tool.

8. The hard metal composite of claim 1 wherein said composite comprises one of a cutting element of an earth-drilling and mining tool.

9. The hard metal composite of claim 1 wherein said composite comprises one of a cutting element of woodworking tools and other material cutting tool.

10. The hard metal composite of claim 1 wherein said composite comprises one of a working surface of a wear part and a compacting tool.

11. The hard metal composite of claim 1 wherein one of the constituent hard metal powders has at least one desired property which is absent in the other constituent hard metal powder.

12. The hard metal composite of claim 1 wherein one of the constituent hard metal powders has at least one desired property which is present to a lesser degree in the other constituent hard metal powder.

13. The hard metal composite of claim 1 wherein hard metal powder of the first constituent grade, which is dispersed in the hard metal powder of the second constituent grade, constitutes from 1% to 50% by weight of the final product.

14. A method of forming a sintered hard metal composite comprising the steps:

(a) uniformly dispersing unsintered nodules of a pre-blended hard metal powder of a first grade into unsintered nodules of a pre-blended hard metal powder of a second grade to form a composite powder blend;

(b) pressing said composite powder blend; and (c) sintering said composite powder blend.

15. The method of claim 14 wherein the hard metal powder of the first grade comprises submicron tungsten carbide particles and between 1% and 15% binder and the hard metal powder of the second grade comprises a coarser grain tungsten carbide and between 1% and 25% binder.

16. A sintered hard metal composite comprising unsintered nodules of a first pre-blended hard metal powder comprising submicron tungsten carbide particles and between 1% and 15% binder uniformly dispersed among unsintered nodules of a pre-blended hard metal powder comprising coarser grain tungsten carbide particles and between 1% and 25% binder, wherein the integrity of the constituent hard metal powders is maintained after sintering, and the resulting composite exhibits properties greater than the average of those properties of the first hard metal powder and the second hard metal powder.

17. The sintered hard metal composite of claim 16 wherein the resulting composite has approximately the same toughness as the coarser grain tungsten carbide and a hardness greater than the hardness of the coarser grain tungsten carbide.

* * * * *